US009886004B2

(12) United States Patent
Altenhoven et al.

(10) Patent No.: US 9,886,004 B2
(45) Date of Patent: Feb. 6, 2018

(54) METHOD AND DEVICE FOR ASSEMBLING A MOVEMENT TO A WATCH CASE

(71) Applicant: ETA SA MANUFACTURE HORLOGERE SUISSE, Grenchen (CH)

(72) Inventors: Thierry Altenhoven, Zollikofen (CH); Andre Kaltenrieder, Preles (CH); Stephane Leoni, Courtelary (CH)

(73) Assignee: ETA SA Manufacturing Horlogere Suisse, Grenchen (CH)

( * ) Notice: Subject to any disclaimer, the term of this patent is extended or adjusted under 35 U.S.C. 154(b) by 19 days.

(21) Appl. No.: 14/784,781

(22) PCT Filed: Mar. 12, 2014

(86) PCT No.: PCT/EP2014/054855
§ 371 (c)(1),
(2) Date: Oct. 15, 2015

(87) PCT Pub. No.: WO2014/173582
PCT Pub. Date: Oct. 30, 2014

(65) Prior Publication Data

US 2016/0062315 A1 Mar. 3, 2016

(30) Foreign Application Priority Data

Apr. 24, 2013 (EP) ..... 13165202

(51) Int. Cl.
*G04B 37/04* (2006.01)
*G04B 37/05* (2006.01)
*G04G 17/08* (2006.01)

(52) U.S. Cl.
CPC ..... *G04B 37/05* (2013.01); *G04B 37/04* (2013.01); *G04B 37/052* (2013.01);
(Continued)

(58) Field of Classification Search
CPC ..... G04B 37/04; G04B 37/05; G04B 37/052; G04B 37/055; G04B 37/057
(Continued)

(56) References Cited

U.S. PATENT DOCUMENTS 646,843 A * 4/1900 Krahenbuhl ..... 368/236
3,352,102 A * 11/1967 Schneider ..... G04B 23/02 368/315

(Continued)

FOREIGN PATENT DOCUMENTS

DE 2 218 623 11/1973
EP 0 770 938 A1 5/1997

(Continued)

OTHER PUBLICATIONS

International Search Report dated May 8, 2014, in PCT/EP14/054855 filed Mar. 12, 2014.

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A device for attachment of a timepiece movement to a watch case, including a peripheral attachment element of the movement positioned in abutment on an axial bearing surface of the case. The device includes thermoformed studs integral with the case having a mushroom shape at an end thereof providing an axial retaining surface acting as a rivet to hold the peripheral attachment element of the movement against the axial bearing surface of the case.

10 Claims, 3 Drawing Sheets

(52) U.S. Cl.
CPC ..... *G04B 37/055* (2013.01); *G04B 37/057* (2013.01); *G04G 17/08* (2013.01)

(58) Field of Classification Search
USPC ..... 368/297–300, 316–318
See application file for complete search history.

(56) References Cited

U.S. PATENT DOCUMENTS 3,367,809 A * 2/1968 Soloff ..... B29C 65/08 156/293
3,875,738 A * 4/1975 Ichikawa ..... G04G 13/02 368/250
3,911,669 A * 10/1975 Burkle ..... G04B 37/052 368/299
4,184,317 A * 1/1980 Kanda ..... G04B 37/052 368/299
4,421,423 A * 12/1983 Lederrey ..... G04B 19/14 368/276
4,505,596 A * 3/1985 Barbieri ..... G04B 19/065 368/236
5,220,541 A * 6/1993 Vuilleumier ..... G04F 7/08 368/110
5,831,939 A * 11/1998 Kaelin ..... G04B 37/05 368/276
2004/0017735 A1* 1/2004 Kotanagi ..... G04B 37/05 368/276
2009/0080294 A1* 3/2009 Arita ..... G04B 19/082 368/232
2009/0245032 A1* 10/2009 Bonnet ..... G04B 37/0008 368/297
2012/0100305 A1* 4/2012 Muller ..... B05D 1/32 427/555
2013/0128707 A1* 5/2013 Mertenat ..... G04B 37/05 368/309

FOREIGN PATENT DOCUMENTS

EP 1079284 A1 * 2/2001 ..... G04B 29/027
EP 1 365 295 A2 11/2003

* cited by examiner

METHOD AND DEVICE FOR ASSEMBLING A MOVEMENT TO A WATCH CASE

CROSS-REFERENCE TO RELATED APPLICATIONS

This is a National phase Application in the United States of International patent Application PCT/EP2014/054855 filed Mar. 12, 2014 which claims priority on European patent Application 13165202.6 filed Apr. 24, 2013. The entire disclosure of the above patent application are hereby incorporated herein by reference.

The present invention concerns a method and a device for attaching a movement to a watch case.

In conventional watchmaking, the movement is often attached to the case middle by means of clamps and screws which are inserted in threads and press a thread of the movement against a shoulder of the case middle. Although this type of attachment has the advantage of being reliable and reversible, it also has the drawback of being relatively complex to implement due to the various manipulations required for the screws and clamps, which seriously affects productivity and makes this method unsuitable for the manufacture of watches intended for mass production.

To attach the movement to the case, there are also known intermediate pressed-in parts, such as casing rings, which also allow small calibrated movements to be fitted in larger cases. However, this method still has the drawback of requiring several assembly steps and additional parts for the attachment. This type of attachment method thus allows for greater flexibility, but provides no significant cost savings.

Some solutions, such as those described in EP Patent No 0770938 by the Applicant, separate the axial positioning means from the lateral positioning means of the case. Axial positioning is always achieved by placing a flange of the movement frame on a shoulder of the case middle, but orifices and centring studs, respectively arranged in the back of the case and in the movement frame, and which are mutually engaged by sliding along the axis of the movement, are provided for lateral positioning. According to a variant, pins are also provided for approximate angular positioning of the movement before mounting the time-setting stem. However, this solution has the drawback of requiring the shape of the frame to be adjusted and also considerably slows down the overall assembly time because of the numerous assembly steps required.

Further, there is known from EP Patent No 1365295 another type of attachment for electronic modules using hooks assembled to the back of the case with the aid of a retaining plate. When the module, which includes a plurality of recesses at the edges of which shoulders are arranged, is inserted in the case, the hooks operate like harpoons? pressing the module against the back of the case. Although this solution is effective and also facilitates any disassembly operations, it also requires a very specific frame structure for the module requiring assembly, which must be provided with through holes for the insertion of the securing hooks, and it also requires a step of assembling an additional part in order to secure the securing hooks to the back cover, such as, for example, by heat welding the retaining plate to guide studs in the preferred embodiment described. This also has the effect of greatly slowing down the production rate.

There therefore exists a need for a method and a device for assembling a movement to a case that is free of these known limitations.

It is an object of the present invention to propose a method and device for attaching a movement to a case different from known solutions and requiring no screws, clamps or casing rings.

These objects are achieved by a method for attaching a timepiece movement to a watch case, a peripheral attachment element of the movement being abuttingly engaged on an axial bearing surface of the case, characterized in that the method includes a step of thermoforming studs integral with the case, so as to locally deform the end of each stud to form a rivet including an axial retaining surface that vertically retains the peripheral attachment element of the movement against the axial bearing surface of the case.

These objects are also achieved by means of a device for attaching a timepiece movement to a watch case, including a peripheral attachment element of the movement positioned in abutment on an axial bearing surface of the case. The device is characterized in that it includes thermoformed studs integral with the case, having a mushroom shaped end with an axial retaining surface acting as a rivet to hold the peripheral attachment element of the movement against the axial bearing surface of the case.

These objects are also achieved by means of a case middle and a movement taken separately for implementing the assembly method, the case middle being characterized in that it includes at least 6 thermoformable attachment studs having a diameter comprised between 1 and 2 millimeters to form fixing rivets adapted to the weight of a movement, and the movement corresponding to a preferred embodiment wherein the peripheral attachment element consists of a collar provided with a plurality of orifices, or of a plurality of lugs, the holes of the lugs or of the collar being provided for the insertion of the studs.

One advantage of the proposed solution is that it facilitates assembly operations, increases the production rate and minimises production costs. The operation of thermoforming the studs to permanently attach the movement can be performed very rapidly without requiring tedious manipulation, which increases productivity. Further, the movement can be assembled on the dial side, which means it is unnecessary to turn the case over, as in a conventional assembly through the back of the case.

Another advantage of the proposed solution is that it is compatible with a large number of movement types, since it does not require any adaptation of the frame, but simply an adjustment of the peripheral attachment parts. It is compatible, in particular, with movements both with and without threads.

Further, according to a particularly advantageous preferred embodiment, no additional attachment parts are required, all the attachment elements being directly integrated in the movement and in the case.

Other advantages will appear from the example implementations of the invention given in the detailed description and illustrated in the annexed Figures, in which.

Figure 1:
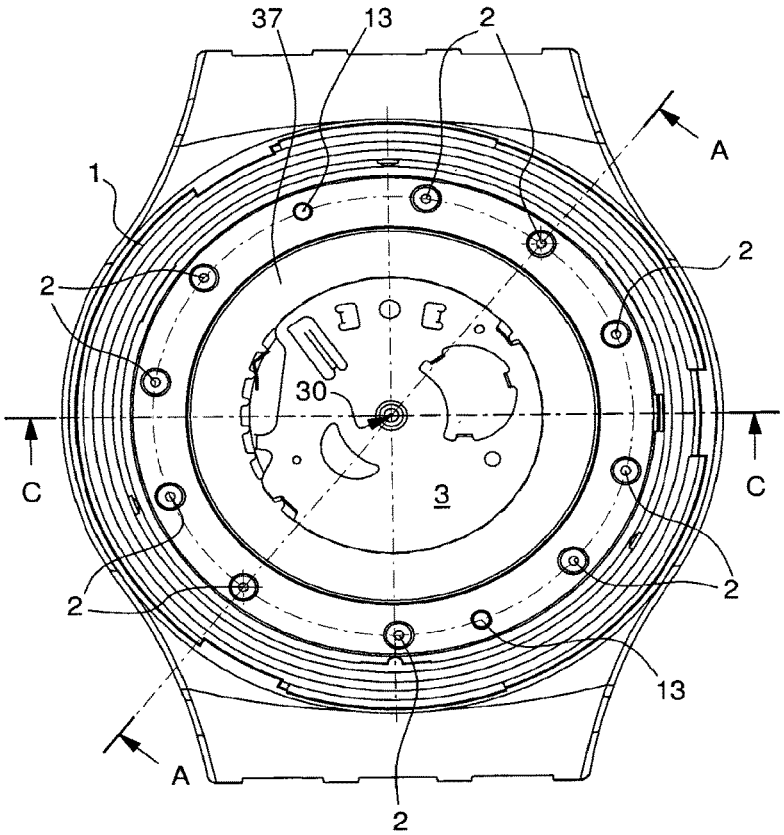
FIG. 1 shows a top view of a movement assembled in a case according to a preferred embodiment of the invention.
Figure 3:
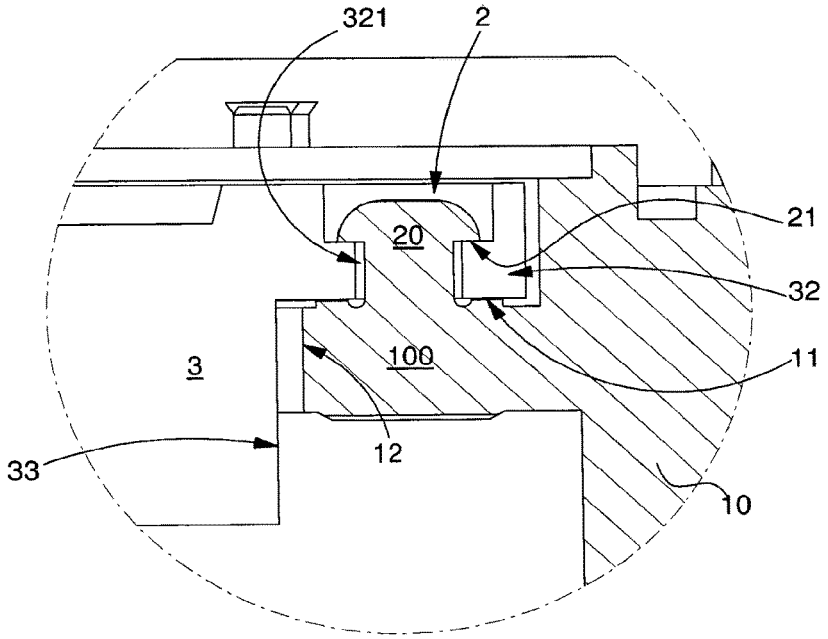
FIG. 3 shows a detailed view of the attachment of the movement to the case middle according to the preferred embodiment of the invention illustrated in FIG. 2.
Figure 4:
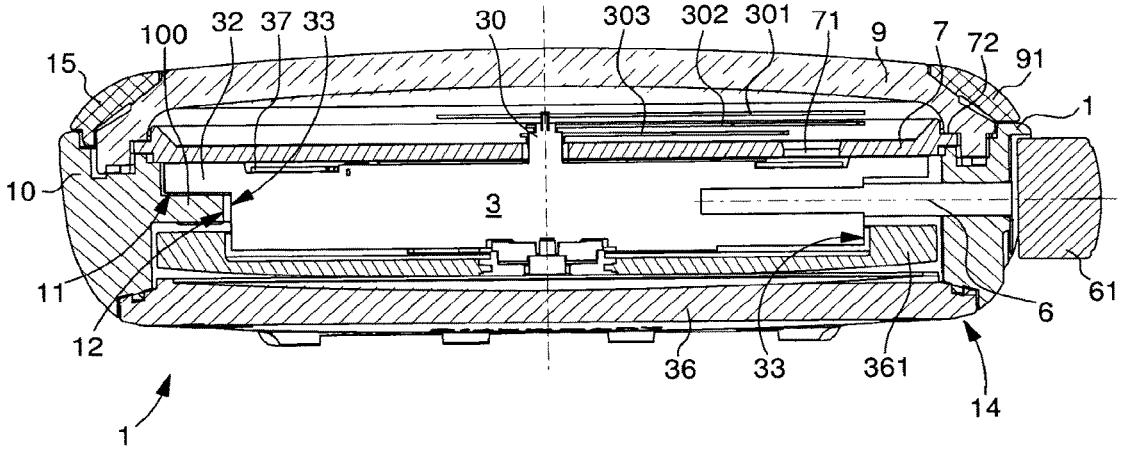
FIG. 4 shows a sectional view along axis C-C, corresponding to the 3 o'clock-9 o'clock watch axis, of a complete watch including a movement assembled to the case according to the preferred embodiment of FIG. 1.

In the following description, reference will be made collectively to FIGS. 1, 2 and 3, which illustrate different views of a preferred embodiment of the device for assembling movement 3 in a case 1 according to the present invention, and to FIG. 4 showing a complete watch using this assembly device. Movement 3 is not provided with a securing thread, but includes, as an attachment element, a collar 32 at its periphery. This collar 32 includes a plurality of orifices 321—ten in total as shown in FIG. 1—intended to receive studs 2. This preferred number of studs 2 is provided for receiving the plate of a movement 3 having a mass of up to 20 grams, when the studs are formed of plastic material. Other parameters relating to the holding of the movement, such as, in particular, the diameter of the studs and the area of axial retaining surface 21 that they provide, are discussed below with reference to FIG. 3.

According to this preferred embodiment, collar 32 used as the peripheral attachment element of movement 3 is preferably integral with the rest of movement 3, which allows the entire component to be manufactured directly by moulding, without requiring any additional dedicated assembly operations for the attachment element. Likewise, orifices 321 can be obtained directly without requiring any specific piercing operations. Similarly, the arrangement of studs 2 directly on case middle 10 saves an assembly step or the additional machining of these attachment elements of the case. In such case, both movement 3 and case middle 10 are preferably made of a plastic material, whose deformation properties are suitable for the thermoforming operation, in order to allow manufacture by means of a simple moulding operation, notably injection moulding. However, peripheral attachment elements could also be used, such as collar 32, made of a different material, such as metal, ceramic or even wood.

According to the invention, the thermoforming of the stud end is provided to fulfil a similar function to that of riveting, i.e. without necessarily attaching the axial retaining surface 21 formed on the end of stud 2 of axial bearing surface 11. Reference will also be made however to a heat welding operation which, depending on the materials employed for case middle 1 and studs 2, does not necessarily involve joining the contact surfaces of said case middle and studs. Those skilled in the art will understand, however, that any such joining of the attachment elements is not detrimental to implementation of the present invention.

In FIG. 1, movement 3 is shown dial side up, although the dial is not yet assembled on its upper face (FIG. 4 described in detail below shows a sectional view of a completely assembled watch with dial 7 affixed to movement 3 and the elements closing case 1, such as back cover 14 and crystal 9). A date ring 37 can be seen inside collar 32 in addition to two series of 5 fixing studs distributed on either side of a diameter on which indexing pins? 13 are arranged in parallel. According to the illustrated preferred embodiment, indexing pins 13 are male elements also arranged directly on case middle 10. They are more precisely machined than studs 2 to ensure the positioning and angular locking of movement 3 in a given position; movement 3 is thus inserted through the dial side by fitting studs 2 in the orifices in collar 32, and at the same time indexing pins 13 in corresponding female elements, preferably arranged at the periphery of movement 3, as here on collar 32.

Figure 2:
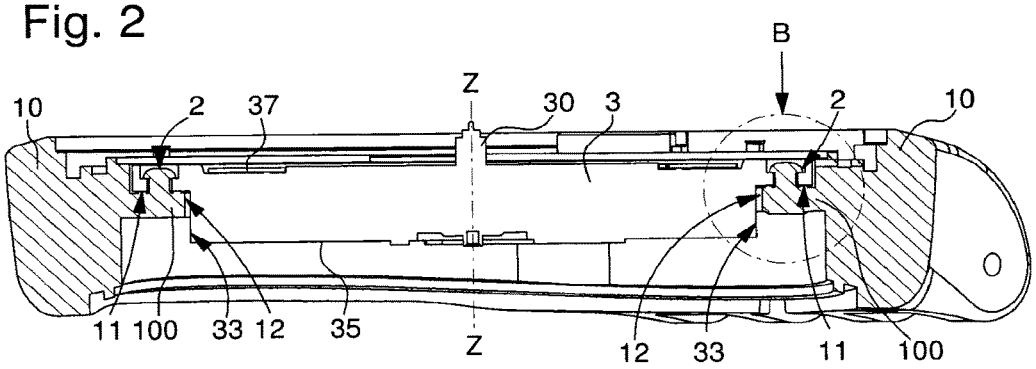
FIG. 2 shows a sectional view along the axis A-A of the movement and of the case according to the preferred embodiment of the invention of FIG. 1.

FIG. 2 shows a sectional view along the axis A-A shown in FIG. 1, of two diametrically opposite studs 2 after the movement is assembled in case 1, i.e. after the thermoforming operation. Case 1 is shown here without its back cover 14—visible in FIG. 4—i.e. represented only by case middle 10, on a prominent portion 100 of which are arranged studs 2. This embodiment is advantageous since it frees space between the bottom of movement 3 and the back of case 14 allowing other components to be accommodated therein, such as, for example, an oscillating weight 36, as illustrated in FIG. 4, while it is not possible to superpose components on the upper face of movement 3 where usually only the dial is placed, and no visual obstruction to reading the time can be envisaged. According to an alternative embodiment, it could, however, also be envisaged to form studs 2 on another part of case 1, such as for example directly on the back cover 14 seen in FIG. 4; however, this variant would require positioning securing collar 32 lower to minimise the height of studs 2 and would be less effective as regards centring if the back is not formed in one-piece with case middle 10.

FIG. 2 shows studs 2 when they have already been deformed by the thermoforming operation and can therefore retain collar 32 vertically on axis Z-Z of wheel? 30 of the watch hands; the detail of the assembly portion inside circle B is shown in FIG. 3. On the upper face of the movement it is still possible to distinguish the date ring 37 seen in FIG. 1, while only the outer side wall 33 of the movement can be seen, as well as a portion of the inner side wall 12 of case 1, with which outer side wall 33 may or may not be in contact. The base of movement 35 also no longer bears on back cover 14 of case 1 (not shown in this Figure), movement 3 being positioned in abutment on the axial bearing surfaces 11 of case middle 10, on which the lower surface of collar 32 bears once the orifices 321 thereof have engaged on fixing studs 2.

FIG. 3 shows the detail of the attachment of the movement to case 1 according to the preferred embodiment of FIG. 2, with collar 32 abutting on axial bearing surface 11 of case middle 10, arranged here on a prominent inner portion 100 of case middle 10. Stud 2, engaged in orifice 321 of collar 32, is deformed by the thermoforming operation and has a mushroom shape 20 at the upper end thereof, which allows the lower surface thereof to provide an axial retaining surface 21 for retaining collar 32 vertically pressed against axial bearing surface 11 of case middle 10. The mushroom 20 thereby formed thus acts like a rivet for the peripheral attachment portion of the movement formed here by collar 32. As can be observed in this Figure, there is not necessarily any contact between outer side wall 33 of the movement and inner side wall 12 of the case middle, which makes it possible to increase machining tolerances at this level, the plate and movement 3 being preferably sufficiently centred by indexing pins 13. The difference between the diameter of orifice 321 of collar 32 and the diameter of stud 2 is, however, preferably selected to be less than 0.2 mm, to avoid excessively decreasing the contact surface between the lower face of mushroom 20 and axial bearing surface 21.

It can also be noted in this Figure that the ratio between the radius of stud 2 and that of mushroom 20 is approximately equal to 1.5, and that the thickness of mushroom 20 is substantially equal to the radius of stud 2. The preferred embodiment of FIG. 1 uses this mushroom shape 21 for a stud 2 having a diameter preferably comprised between 1 and 2 mm, which can support a movement 3 having a weight of more than 10 grams, with a number of plastic studs greater than or equal to 6. Owing to the hyperbolic reduction in the stresses exerted on each stud 2 as a function of the number of studs, in the interests of economy, the number of studs 2 could also be limited to being at most equal to 15. In order to minimize the number of studs 2, it is also possible to vary the material of which they are formed by selecting a more rigid material than the plastic usually used for watch case middles.

FIG. 4 shows a view of a complete watch using the assembly method and device described in FIGS. 1 to 3 above, along the sectional axis C-C illustrated in FIG. 1 corresponding to the 3 o'clock-9 o'clock axis which does not pass through thermoformed studs 2, unlike the sectional axis of FIGS. 2 and 3. There is shown again attachment collar 3, which takes the form, at this angle, of an annular shoulder, bearing on axial bearing surface 11 arranged on the upper surface of prominent inner portion 100 of case middle 10. On the upper face of the movement on the dial side, there is shown again date ring 37, but this time it is surmounted by a dial 7 above which rotate the seconds hand 301, minute hand 302 and hour hand 303, driven by the central wheel 30 of movement 3, and which is also provided with an aperture 71 revealing the current date values. The peripheral portion 72 of the dial is clamped by crystal 9 surmounted by a bezel 91, and which is assembled to a shoulder 15 of case middle 10, for example with the aid of ultrasound welding. Case middle 10 is traversed by a stem 6 including, in a conventional manner, a crown 61 at the distal end thereof for easy operation by the user. Case 1 is closed by a back cover 14 above which is accommodated an oscillating weight 36 coupled to movement 3 for the automatic winding thereof, and whose lateral edges 361 rise as far as the lower level of prominent inner portion 10 of case middle 10.

The attachment device and method proposed thus apply to every type of watch, both to quartz and entirely mechanical watches.

Figure 5:
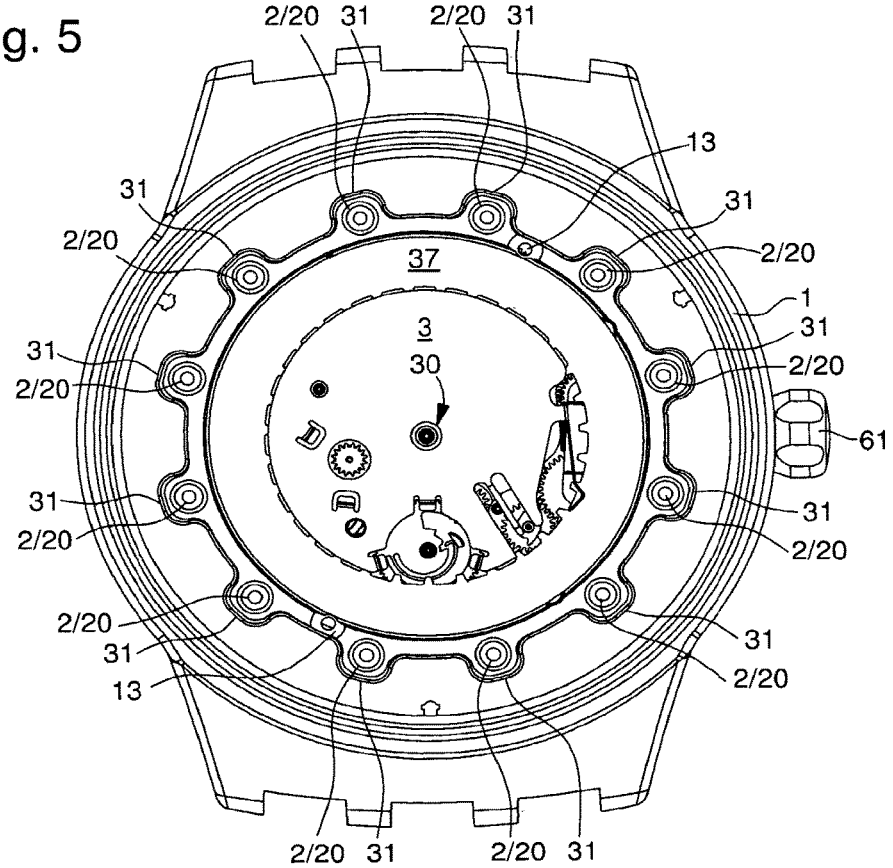
FIG. 5 shows a sectional view of a movement assembled in a case according to an alternative embodiment of the invention.

Other attachment variants are possible for creating the peripheral attachment element, which may, for example, have attachment lugs 31 in place of holed collar 32 for accommodating studs 2. One such variant is illustrated in FIG. 5 which shows a similar top view to FIG. 1 of a watch more clearly illustrating the mushroom shape 20 acting as a rivet at the stud ends and with the shape of lugs 31 closely matching the shape of stud 2. Lugs 31 are in this case simply arranged to have a central securing hole in which studs 2 have to be inserted before the thermoforming operation, in addition to upper and lower bearing surfaces for the axial holding thereof on the vertical axis corresponding to that of the wheel 30 for the hands. They therefore reduce the volume of material required to form the attachment element of the movement and thereby optimise costs. According to this alternative embodiment, the degree of freedom in rotation is preferably still locked by means of indexing pins 13. Otherwise, FIG. 5 also shows, in addition to date ring 37 at the periphery of movement 3, the gripping crown 61 at 3 o'clock on case 1.

Figure 6:
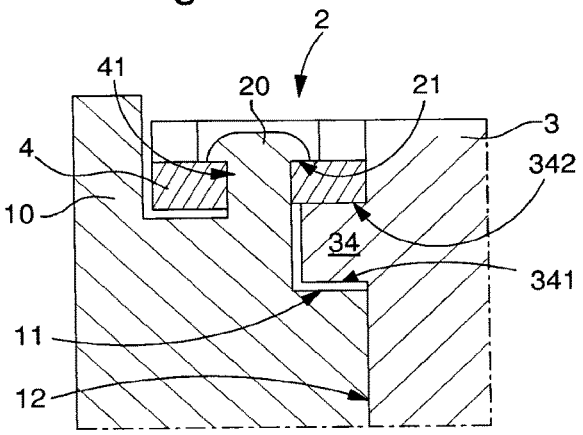
FIG. 6 shows a sectional view of an alternative mode of attachment of the movement in a case middle according to an alternative embodiment of the invention.

FIG. 6 illustrates another alternative embodiment of the method and device for attaching a movement, according to which movement 3 again includes a thread 34, unlike those of the preferred embodiment which had no thread, and a retaining ring 4. The movement thread 34, which is used as the attachment element, with lower surface 341 of the thread then being positioned in abutment on an axial bearing surface 11 of case middle 10, and then retaining ring 4, including a plurality of holes 41, is fitted on studs 2 preferably integral with case middle 10. The operation of thermoforming studs 2 forms mushrooms 20 above retaining ring 4 and the axial retaining surface 21 thereby produced presses retaining ring 4 against an upper surface 342 of movement thread 34, which in turn remains clamped against axial bearing surface 11 of case middle 10. The advantage of this alternative variant is that it makes it possible to use a conventional movement 3 with a thread 34; the drawback, however, is that it requires the use of an additional part—retaining ring 4—so that the attachment elements are no longer directly integrated respectively in case 1 and in movement 3.

Figure 7:
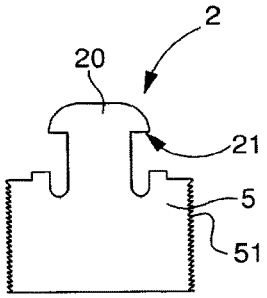
FIG. 7 shows a sectional view of an alternative mode of attachment of the movement in a case middle, using studs arranged on removable parts.

FIG. 7 illustrates another alternative embodiment of the invention concerning studs 2, which are arranged on bushes 5 provided with grooves 51 arranged to facilitate the pressing of bushes 5 into holes in case 1, preferably in case middle 10. This modular arrangement of the bushes allows the material selected for case middle 10 to be dissociated from that selected for the studs; it would thus be possible, for example, to choose plastic bushes 5 but a metal case middle 10. It will also be understood that this variant of removable studs 2 is compatible with all the other embodiments described above with reference to FIGS. 1 to 6.

The invention claimed is:

1. A method for attaching a timepiece movement to a watch case, the method comprising:

mounting a peripheral attachment element integral with the movement to abuttingly engage on an axial bearing surface of the case, the peripheral attachment element projecting in a peripherally outward manner relative to the movement and including orifices;

inserting studs integral with the case into the orifices; and thermoforming the studs to locally deform an end of each stud to form a rivet including an axial retaining surface that vertically retains the peripheral attachment element of the movement against the axial bearing surface of the case.

2. A case middle for implementing the attachment method according to claim 1, wherein the case middle include at least 6 thermoformable fixing studs each having a diameter between 1 and 2 millimeters.

3. The case middle according to claim 2, wherein the studs are formed in one-piece with the case middle.

4. The case middle according to claim 2, wherein the studs are arranged on a removable bush pressed into the case.

5. A movement for implementing the attachment method according to claim 1, wherein the peripheral attachment element is formed by a collar including a plurality of lugs.

6. The method for attaching a timepiece movement to a watch case according to claim 1, wherein the movement is inserted from a dial side.

7. A device for attachment of a timepiece movement to a watch case, the device comprising:

a peripheral attachment element integral with the movement, the peripheral attachment element projecting in a peripherally outward manner relative to the movement and including orifices; and studs being integral with the case and be inserted into the orifices, wherein the studs are thermoformed to form a mushroom-shaped end having an axial retaining surface acting as a rivet to hold the peripheral attachment element of the movement against the axial bearing surface of the case.

8. The device for attachment of a timepiece movement to a case according to claim 7, further comprising a positioning member arranged on a case middle to angularly position the movement in the case.

9. The device for attachment of a timepiece movement to a case according to claim 7, wherein the movement is inserted from a dial side.

10. A device for attachment of a timepiece movement to a watch case, the device comprising:

a peripheral attachment element of the movement positioned in abutment on an axial bearing surface of the case and including through holes;

thermoformable studs integral with the case, the studs being thermoformed after being inserted in the through holes, and the thermoformed studs including a mushroom-shaped end including an axial retaining surface acting as a rivet to hold the peripheral attachment element of the movement against the axial bearing surface of the case; and a retaining ring, the movement further including a shoulder, the axial retaining surface of the studs pressing the retaining ring against an upper surface of the shoulder.

* * * * *